US008579162B2

(12) United States Patent
Dyer et al.

(10) Patent No.: US 8,579,162 B2
(45) Date of Patent: Nov. 12, 2013

(54) ENCLOSURE FOR USE WITH A GRAVITY FED FLUID DISPENSING SYSTEM

(75) Inventors: John J. Dyer, Shoreview, MN (US); Arthur V. Lang, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 698 days.

(21) Appl. No.: 12/760,105

(22) Filed: Apr. 14, 2010

(65) Prior Publication Data

US 2011/0253742 A1 Oct. 20, 2011

(51) Int. Cl.
*B67B 1/00* (2006.01)

(52) U.S. Cl.
USPC ..... 222/153.04; 222/145.5; 222/168; 222/182; 222/325; 222/652; 399/114; 422/270; 68/174; 141/346; 141/349; 141/384; 141/386

(58) Field of Classification Search
USPC ..... 222/651–652, 145.5–145.6, 153.04, 222/154–159, 167–168, 185.1, 465.1, 325, 222/182–183, 321.7–321.8, 162, 80–91; 399/34–35, 110–114, 119–120; 422/266, 269–272, 303, 554; 68/171–174, 17 R; 141/9, 21–22, 141/67–68, 70, 291–292, 105–107, 301, 141/351–355, 348–349, 346, 339, 360–366, 141/383–386
See application file for complete search history.

(56) References Cited

U.S. PATENT DOCUMENTS

| | | | | | |
|---|---|---|---|---|---|
| 3,647,115 | A * | 3/1972 | McCann et al. | ..... | 222/39 |
| 4,408,701 | A | 10/1983 | Jeans | | |
| 4,569,623 | A * | 2/1986 | Goldmann | ..... | 414/217 |
| 4,674,654 | A * | 6/1987 | Fujii et al. | ..... | 222/39 |
| 5,071,035 | A * | 12/1991 | Kiplinger | ..... | 222/83.5 |
| 5,125,536 | A * | 6/1992 | Winder | ..... | 222/83.5 |
| 5,143,262 | A * | 9/1992 | Edlund | ..... | 222/129 |
| 5,169,029 | A * | 12/1992 | Behar et al. | ..... | 222/1 |
| 5,209,565 | A * | 5/1993 | Goncalves | ..... | 366/130 |
| 5,417,233 | A * | 5/1995 | Thomas et al. | ..... | 134/93 |
| 5,425,404 | A | 6/1995 | Dyer | | |
| 5,435,451 | A | 7/1995 | Dyer | | |
| 5,593,068 | A * | 1/1997 | Kitayama et al. | ..... | 222/167 |
| 5,826,749 | A * | 10/1998 | Howland et al. | ..... | 222/1 |
| 5,967,383 | A * | 10/1999 | Hidalgo | ..... | 222/516 |
| 6,325,115 | B1 * | 12/2001 | Cowland et al. | ..... | 141/346 |
| 6,354,346 | B2 * | 3/2002 | Arsenault et al. | ..... | 141/291 |
| 6,450,214 | B1 | 9/2002 | Dyer et al. | | |
| 6,773,668 | B1 * | 8/2004 | Everson et al. | ..... | 422/28 |
| 7,111,654 | B2 * | 9/2006 | Takagi | ..... | 141/351 |
| 7,219,517 | B2 * | 5/2007 | Maeng | ..... | 68/17 R |
| 7,861,896 | B2 | 1/2011 | Biesheuvel | | |
| 2005/0072793 | A1 * | 4/2005 | Mehus et al. | ..... | 222/77 |
| 2008/0314927 | A1 * | 12/2008 | Martin | ..... | 222/145.1 |
| 2010/0187264 | A1 | 7/2010 | Rethmeier | | |

OTHER PUBLICATIONS

International Search Report for PCT/US2011/032435 prepared by Korean Intellectual Property Office, mailed Dec. 7, 2011.

* cited by examiner

*Primary Examiner* — Paul R Durand
*Assistant Examiner* — Andrew P Bainbridge
(74) *Attorney, Agent, or Firm* — David B. Patchett

(57) ABSTRACT

An enclosure for use with a gravity fed fluid dispensing system includes a housing with a base member and a cover member that is movably connected with the base member. The base member and cover member define an interior chamber for receiving a bottle. An actuator is movably connected with the housing and arranged to rotate the bottle within the housing.

15 Claims, 3 Drawing Sheets

ENCLOSURE FOR USE WITH A GRAVITY FED FLUID DISPENSING SYSTEM

BACKGROUND

The present invention relates generally to fluid dispensing and, more particularly, to a gravity fed fluid dispensing system.

Gravity fed fluid dispensing systems are known in the prior art. U.S. Pat. No. 5,425,404 (Dyer), for example, discloses a gravity based system for accurately dispensing a fluid and for mixing the fluid with another fluid. The system includes a bottle containing a quantity of the fluid. The bottle may be inverted and engaged with a dispenser assembly. The system is constructed so that the bottle is opened to allow the fluid to flow through the system when the bottle is engaged with the system, and to close the bottle when not engaged with the system. A second fluid may be introduced into the system and mixed with the first fluid in a controlled manner to dilute the first fluid

SUMMARY

Fluid dispensing systems are prone to misuse and tampering. For example, bottles may be inadvertently misplaced or stolen, users may squeeze the bottle during dispensing, thereby interfering with the proper dispensing rate, and bottles may inadvertently be left in their open/dispensing position after a filling operation has been completed, thereby resulting in contents of the bottle being wasted. It would be desirable to provide a fluid dispensing system that minimizes or prevents such misuse and tempering.

The invention overcomes the above-identified limitations in the field by providing an enclosure for use with a gravity fed fluid dispensing system including a dispensing unit and a bottle rotatably connected with the dispensing unit and movable between a closed position and an open dispensing position, wherein the enclosure includes a housing comprising a base member and a cover member movably connected with the base member, the base member and cover member defining an interior chamber sized to receive the bottle and allow for rotation of the bottle relative to the dispensing unit, and an actuator movably connected with the housing and arranged to rotate the bottle within the chamber.

In a more specific aspect, the cover member may be movable between an open position that allows access to the chamber, thereby allowing a bottle to be connected with and/or disconnected from the dispensing unit, and a closed position that restricts access to the chamber, thereby preventing the bottle from being removed from the dispensing unit.

In another aspect, the actuator may include a handle and a bottle engagement member rotatably connected with the cover member. The bottle engagement member may be arranged to engage and rotate the bottle relative to the dispensing unit when the cover member is in its closed position and the handle is rotated.

In another aspect, the cover member may include opposed first and second opposed major surfaces, and the handle may be arranged adjacent the cover member first major surface, and the bottle engagement member may be arranged adjacent the cover member second major surface.

In another aspect, the bottle engagement member may comprise a pair of spaced walls extending outwardly from the cover member second major surface. The actuator may further include a biasing member, so that when the bottle is inverted and connected with the dispensing unit, the biasing member is arranged to engage the bottom of the bottle when the cover member is in its closed position, thereby to exert pressure against the bottle in the direction of the dispensing unit.

In another aspect, the handle may be separable from the cover member. The handle may include a manually actuatable latch that allows the handle to be manually disconnected from the cover member. In other aspect, the handle may be provided in the form of a generally circular dial, or the handle may comprise a lever that extends outwardly beyond the outer periphery of the cover member.

In another aspect, the enclosure may comprise an alarm for indicating when the bottle has been actuated to its dispensing position. The actuator may include a cam member operatively associated with the bottle engagement member, and the cam may be arranged to activate the alarm when the actuator is rotated to urge the bottle into its dispensing position.

The enclosure may also include a lock for securing the cover member to the base member, thereby to provide additional security.

In another aspect, the base member may include a transparent window for allowing a user to view the condition of the bottle when the bottle is connected with the dispensing unit.

In another aspect, the base member may include an upper opening, and the cover member may be movable to provide access to the base member upper opening, thereby allowing a user to insert the bottle into the dispensing unit.

In another aspect, the present invention provides a gravity fed fluid dispensing assembly including a dispensing unit, a bottle movably connected with the dispensing unit, and an enclosure as described herein. In another aspect, a dispensing station may be formed by interconnecting a plurality of dispensing assemblies, wherein each dispensing assembly is in fluid communication with the next adjacent dispensing assembly.

An advantage of certain embodiments of the invention include that it prevents users from squeezing a bottle during dispensing, it prevents bottles from being lost or stolen, it notifies a user when the bottle is in its dispensing position, thereby reminding the user to return the bottle to its closed position once the dispensing operation has been completed, it allows a user to easily connect a bottle with a dispensing unit, it allows a user to easily and repeatably rotate a bottle between opened and closed dispensing positions, it provides a snug connection between the bottle and the dispensing unit, and it allows a user to easily view the condition of the bottle when the bottle is installed in the dispensing system.

BRIEF DESCRIPTION OF THE DRAWINGS

The present invention will be further described with reference to the accompanying drawings, in which.

DETAILED DESCRIPTION

Figure 1:
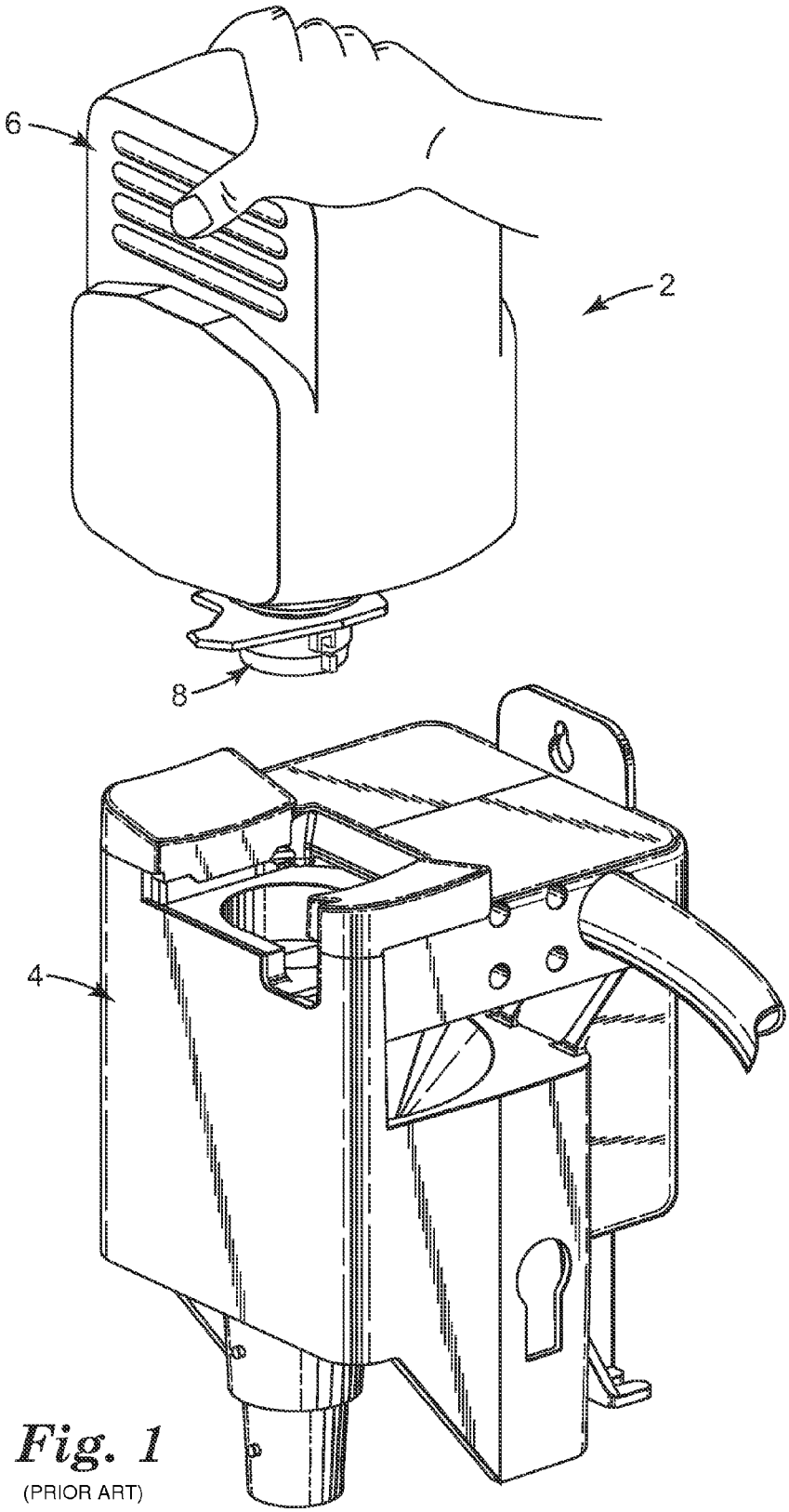
Fig. 1 (PRIOR ART)
FIG. 1 is a perspective view of a gravity fed fluid dispensing system according to the prior art.

Referring now to the drawings, wherein like reference numerals refer to like or corresponding parts throughout the several views, FIG. 1, shows a gravity fed fluid dispensing system 2 as described in U.S. Pat. No. 5,425,404 (Dyer), the contents of which are incorporated herein by reference. The fluid dispensing system 2 generally includes a dispensing unit 4, and a bottle 6 containing a quantity of fluid that is to be dispensed. Typically, the fluid is provided in a concentrated form (the "concentrate") with the intention that the concentrate will be diluted with at least one other diluting fluid (the "dilutant"), which is typically water, prior to being dispensed and used.

Although the dispensing system 2 may employ any suitable bottle or other container for the concentrate, in one embodiment, the bottle 6 is constructed according to U.S. Pat. No. 5,435,451 (Dyer), the contents of which are incorporated herein by reference. The bottle 6 is designed for use in conjunction with a device for controlling the flow of fluid through the orifice, such as a valve cap 8. The valve cap 8 may be of any suitable design including the design disclosed in U.S. Pat. No. 6,450,214 (Dyer et al.) or U.S. Pat. No. 4,408,701 (Jeans), the contents of which are incorporated herein by reference.

Figure 2:
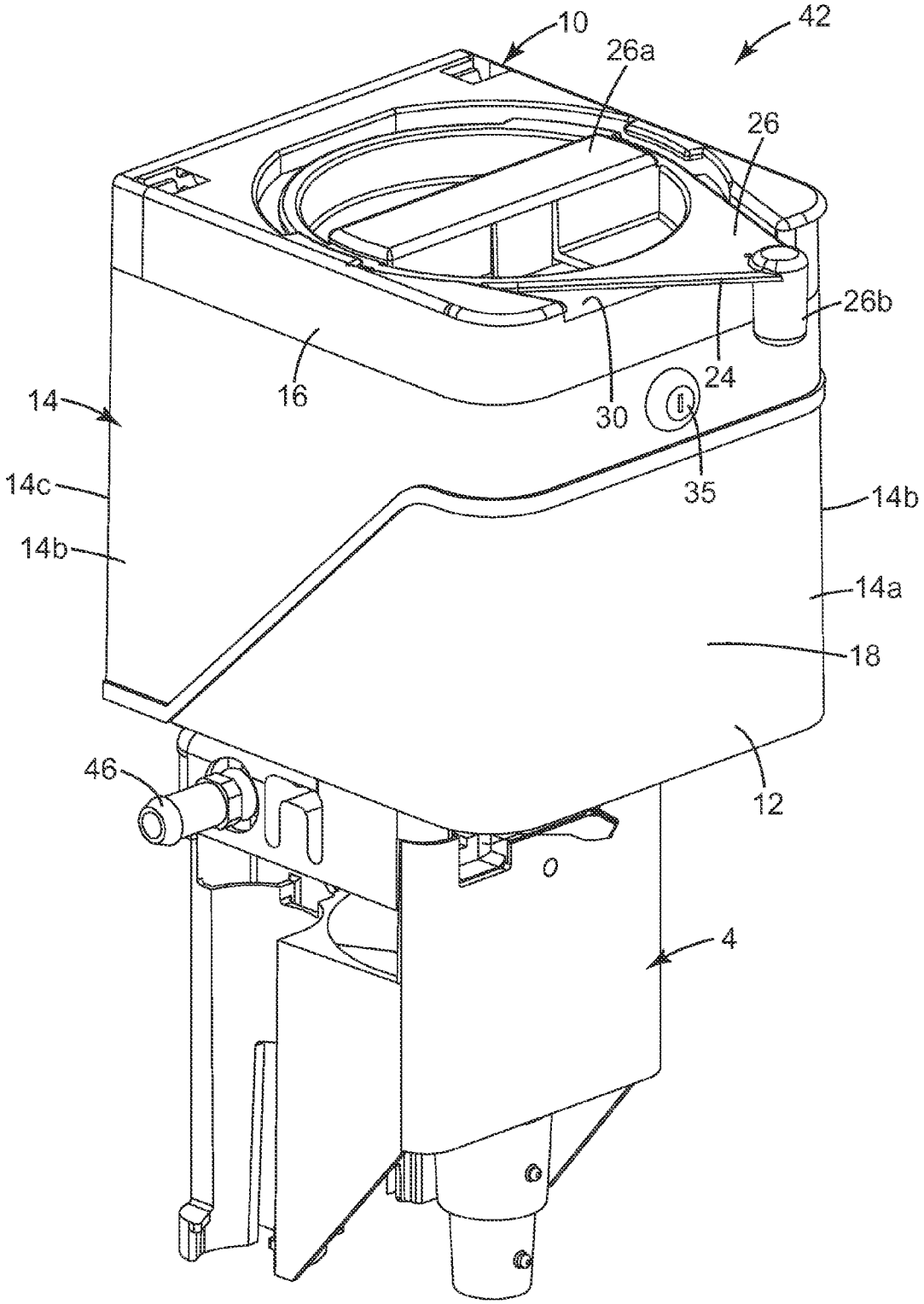
FIG. 2 is a perspective view of a gravity fed fluid dispensing system including an enclosure according to the invention in its closed condition.
Figure 3:
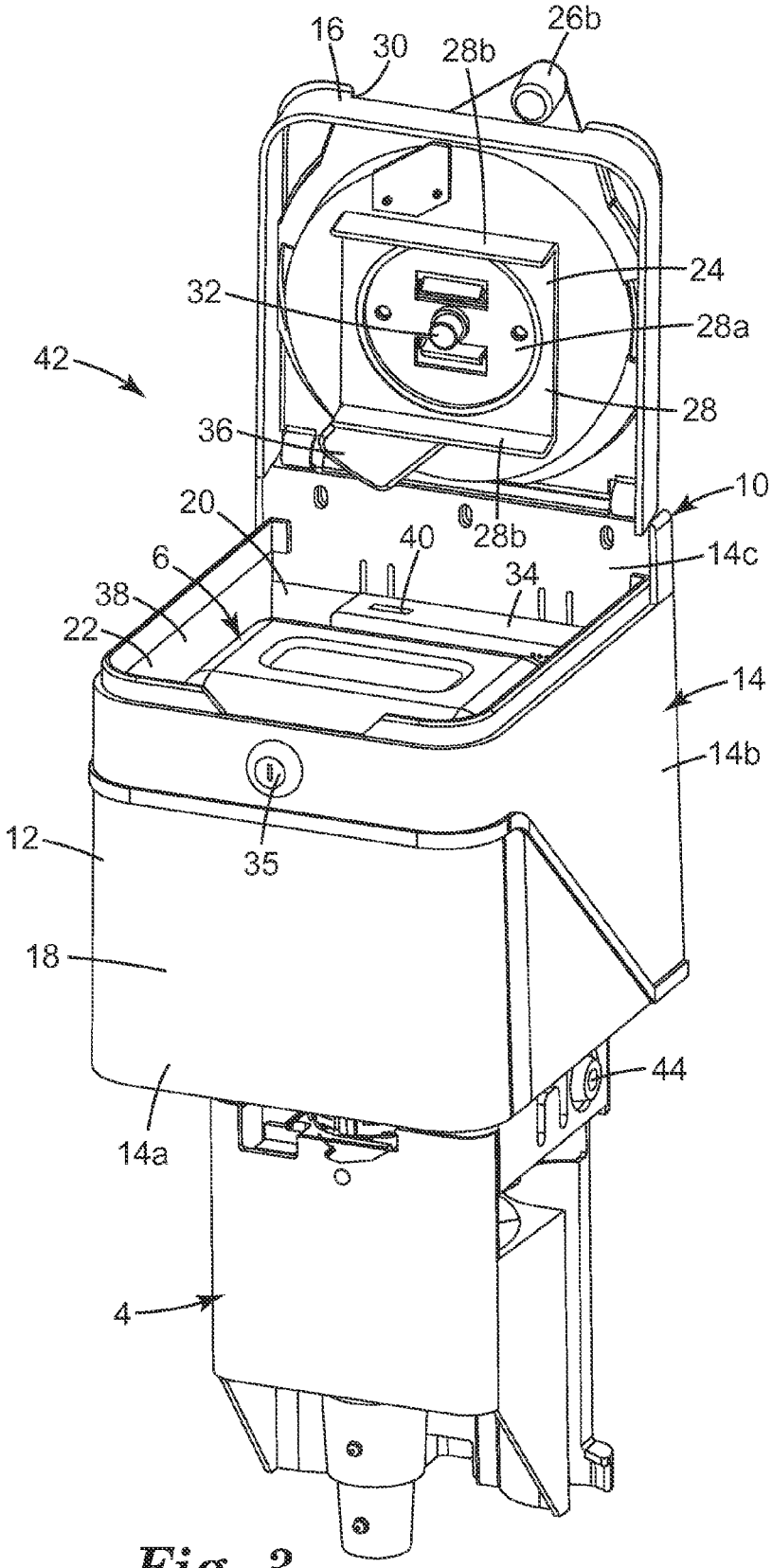
FIG. 3 is a perspective view of a gravity fed fluid dispensing system including an enclosure according to the invention in its open condition.

Referring now to FIGS. 2 and 3, there is shown an enclosure 10 suitable for use with a fluid dispenser such as the dispensing system 2 described above. The enclosure 10 comprises a housing 12 including a base member 14 and a cover member 16. In the illustrated embodiment, the base member 14 includes a front wall 14*a*, side walls 14*b*, and a back wall 14*c*. In a specific aspect, the front wall 14*a* includes a transparent viewing window 18 that allows a user to view the bottle 6 when it is positioned within the enclosure 10 to see, for example, how much liquid is remaining in the bottle 6, or to see if the bottle 6 is in its rotated position. The enclosure 10 may be mounted to, for example, a generally vertical wall surface (not shown) using known mounting techniques.

The base member 14 and cover member 16 combine to form a hollow interior region or chamber 20 sized to accommodate the bottle 6. That is, the chamber 20 is sufficiently large to allow the bottle 6 to be connected with the dispensing unit 4, sufficiently large to allow the bottle 6 to be rotated relative to the dispensing unit 4 during the dispensing operation, and sufficiently large to allow the bottle 6 to be disconnected and removed from the dispensing unit 4. The base member 14 includes an opening 38 at its upper end, and the cover member 16 is movable to provide access to the chamber 20 via the opening 38, thereby allowing a user to connect the bottle 6 with the dispensing unit 4.

In the illustrated embodiment, the base member 14 is sized so that when a bottle 6 is connected with the dispensing unit 4, there is a laterally extending peripheral gap 22 between the bottle 6 and the inner wall surface of the base member 14. This gap 22 is provided to allow a user to maneuver the bottle 6 within the chamber 20 to install and remove the bottle 6 from the dispensing unit 4, and to allow the bottle 6 to be rotated between its closed/off position and its open/dispensing position. In a specific embodiment, the gap 22 may have a width of at least about 0.125 inches, 0.25 inches, or 0.5 inches.

In the illustrated embodiment, the cover member 16 is pivotally connected with the base member 14, thereby allowing the cover member 16 to be repeatably moved between a closed position (illustrated in FIG. 2), and an open position (illustrated in FIG. 3). Other means of movably connecting the cover member 16 with the base member 14 are also contemplated. For example, the cover member 16 and base member 14 may be snap fit, friction fit, or slidably connected.

In its open position, the cover member 16 is arranged in at least partially spaced relation relative to the base member 14, thereby providing access to the interior chamber 20 of the enclosure 10, and allowing a bottle 6 to be connected with and/or disconnected from the dispensing unit 4. In its closed position, the cover member 16 is arranged adjacent to, and is in engagement with, the base member 14, thereby limiting access to the interior chamber 20 of the enclosure 10, and preventing the bottle 6 from being removed from the dispensing unit 4.

To facilitate access to the opening 38, the cover member 16 may include a spring hinge that normally urges the cover member 16 to its open position. Other means of maintaining the cover member 16 in its open position, such as clips, clasps, hooks, or a hook-and-loop connector, may be used to removably attach the cover member 16 to the vertical wall surface to which the enclosure 10 is mounted, thereby allowing the cover member 16 to be temporarily connected with the wall surface during the installation and/or removal of the bottle 6 from the dispensing unit 4.

The enclosure 10 further comprises an actuator 24 movably connected with the housing 12. The actuator 24 serves to rotate the bottle 6 within the housing 12 relative to the dispensing unit 4 when the cover member 16 is in its closed position. In the illustrated embodiment, the actuator 24 is rotatably connected with the cover member 16, and includes a handle 26 arranged adjacent the top surface of the cover member 16, and a bottle engagement member 28 arranged adjacent the bottom surface of the cover member 16.

In one aspect, the handle 26 may be detachable or removable from the enclosure 10. That is, the handle 26 may include, for example, a manually actuatable latching mechanism that allows a user to manually disconnect the handle 26 from the cover member 16 and bottle engagement member 28. By making the handle 26 removable, a single handle may be used to operate a number of different dispensing assemblies.

In the illustrated embodiment, the bottle engagement member 28 includes a top wall portion 28*a*, and a pair of spaced side wall portions 28*b* that extend outwardly from the top wall portion in a direction away from the bottom surface of the cover member 16. Arranged in this manner, the spaced side wall portions 28*b* extend partially into the interior chamber 20 of the housing 12, such that when an inverted bottle is installed in the dispensing unit 4, and the cover member 16 is closed, and the handle 26 is rotated, the side wall portions 28*b* engage and rotate the bottle 6 relative to the dispensing unit 4 to allow liquid in the bottle 6 to be dispensed.

In the illustrated embodiment, the handle 26 includes a dial portion 26*a* and a lever portion 26*b*. It will be recognized that the handle 26 may be operated using either the dial 26*a* or the lever 26*b*, and that the handle 26 need not include both the dial 26*a* and lever 26*b*. The handle 26 allows a user to manually actuate the bottle 6 within the closed housing 12 when the cover member 16 is closed. This may be accomplished by either grasping and turning the dial portion 26*a*, and/or by turning the lever portion 26*b* of the handle 26. In other embodiments, the actuator 24 may be motorized.

In the illustrated embodiment, the illustrated dial 26*a* is generally circular, and is recessed into, or set into, the top of the cover member 16, and the lever 26*b* extends outwardly beyond the outer periphery of the cover member 16. The cover member 16 includes a channel or slot 30 that limits the extent of travel of the lever 26*b*. The length of the slot 30 corresponds with the amount of rotation necessary to open the valve cap 8 and allow liquid to be dispensed from the bottle 6. That is, when the dial 26*a* and/or lever 26*b* is urged to one end of the slot 30, the bottle 6 will be in its closed/non-dispensing position, and when the dial 26*a* and/or lever 26*b* is urged to the opposite end of the slot 30, the bottle 6 will be in its fully open/dispensing position. In this manner, the slot prevents a user from over-rotating the bottle 6, which may result in damage to the valve cap 8 and/or actuator 24.

In the illustrated embodiment, the enclosure 10 includes an alarm 34 that serves to provide an indicator to a user when the bottle 6 has been actuated to its dispensing position. The alarm 34 may provide a visual and/or audible indication that the bottle 6 is in its dispensing position. This indication, in turn, serves as a reminder to a user that the bottle 6 is to be returned to its closed or non-dispensing position once the dispensing operation has been completed.

The actuator 24 includes a cam 36 connected with the bottle engagement member 28 that engages a switch 40 on the alarm to activate the alarm 34 when the actuator 24 and the associated bottle have been rotated. That is, the cam 36 is arranged to activate the alarm 34 when the actuator 24 is rotated to urge the bottle 6 into its dispensing position.

In the illustrated embodiment, the actuator 24 further includes a biasing member 32 extending outwardly from the top wall portion 28*a* of the bottle engagement member 28 intermediate the spaced walls 28*a*. Arranged in this manner, when an inverted bottle 6 is connected with the dispensing unit 4, the biasing member 32 engages the bottom of the inverted bottle 6 when the cover member 16 is moved to its closed position, thereby exerting a force against the bottle 6 in the direction of the dispensing unit 4, which, in turn, ensures that a secure connection is formed between the bottle 6 and the dispensing unit 4.

In one aspect, the enclosure 10 may further include a lock 35, such as a pad lock, cam lock with a key, combination lock or electronic lock, to secure the cover member 16 to the base member 14, thereby providing the enclosure 10 with additional security against possible theft or tampering with the bottle 6.

When used in connection with the dispensing system 2, the enclosure 10 forms a tamper resistant gravity fed fluid dispensing assembly 42 that includes a dispensing unit 4, a bottle 6 movably connected with the dispensing unit 4, and the enclosure 10. The enclosure 10 provides security and protects against intentional or accidental misuse of the dispensing assembly 42. That is, the enclosure 10 prevents unauthorized individuals from removing the bottle 6 from the dispensing unit 4, and prevents users from squeezing the bottle 6 and altering the flow of liquid from the bottle 6 during use. The enclosure 10 also allows the bottle 6 to be easily installed and removed from the dispensing unit 4, allows the bottle 6 to be easily rotated during use, and allows the condition of the bottle 6 to be readily ascertained by a user.

To allow individual dispensing assemblies 42 to be dedicated to specific end use applications, and thereby minimize interchanging multiple bottles on a single dispensing system, a plurality of dispensing assemblies 42 may be interconnected to form a dispensing station. In this manner, individual dispensing assemblies 42 may be dedicated to specifics types of concentrate, such as a general purpose cleaner, a degreaser, and a window cleaner. Each dispensing unit 4 includes a dilutant inlet port 44 that is connected with a dilutant supply, such as a water supply hose (not shown), and a dilutant outlet port 46 that is connected in series to the inlet port of an adjacent dispensing unit. In this manner, a series of dispensing systems may be arranged in fluid communication with one another to form the dispensing station.

Persons of ordinary skill in the art may appreciate that various changes and modifications may be made to the invention described above without deviating from the inventive concept. Thus, the scope of the present invention should not be limited to the structures described in this application, but only by the structures described by the language of the claims and the equivalents of those structures.

What is claimed is:

1. An enclosure for use in connection with a gravity fed fluid dispensing system including a dispensing unit and a bottle rotatably connected with the dispensing unit and movable between a closed position and an open dispensing position, the enclosure comprising:

(a) a housing comprising a base member and a cover member movably connected with the base member, the base member and cover member defining an interior chamber sized to receive the bottle and allow for rotation of the bottle relative to the dispensing unit; and (b) an actuator movably connected with the housing and arranged to rotate the bottle within the chamber from the closed position to the open dispensing position, wherein the actuator includes a handle and a bottle engagement member rotatably connected with the cover member, the bottle engagement member being arranged to engage and rotate the bottle relative to the dispensing unit when the cover member is in its closed position and the handle is rotated, and further wherein the cover member includes first and second opposed major surfaces, and the handle is arranged adjacent the cover member first major surface, and the bottle engagement member is arranged adjacent the cover member second major surface.

2. An enclosure as defined in claim 1, wherein the cover member is movable between an open position that allows access to the chamber, thereby allowing a bottle to be connected with and/or disconnected from the dispensing unit, and a closed position that restricts access to the chamber, thereby preventing the bottle from being removed from the dispensing unit.

3. An enclosure as defined in claim 1, wherein the actuator includes a bottle engagement member comprising a pair of spaced walls extending outwardly from the cover member second major surface.

4. An enclosure as defined in claim 1, wherein the actuator further includes a biasing member, and wherein when the bottle is inverted and connected with the dispensing unit, the biasing member is arranged to engage the bottom of the bottle when the cover member is in its closed position, thereby to exert pressure against the bottle in the direction of the dispensing unit.

5. An enclosure as defined in claim 1, wherein the handle is separable from the cover member.

6. An enclosure as defined in claim 5, wherein the handle includes a manually actuatable latch that allows the handle to be manually disconnected from the cover member.

7. An enclosure as defined in claim 1, wherein the handle is a circular dial.

8. An enclosure as defined in claim 1, wherein the handle comprises a lever extending outwardly beyond the outer periphery of the cover member.

9. An enclosure as defined in claim 1, further comprising an alarm for indicating when the bottle has been actuated to its dispensing position.

10. An enclosure as defined in claim 9, wherein the actuator includes a cam member operatively associated with the bottle engagement member, and further wherein the cam is arranged to activate the alarm when the actuator is rotated to urge the bottle into its dispensing position.

11. An enclosure as defined in claim 1, further comprising a lock for securing the cover member to the base member.

12. An enclosure as defined in claim 1, wherein the base member includes a transparent window portion for allowing a user to view the condition of the bottle.

13. An enclosure as defined in claim 1, wherein the base member includes an upper opening, and wherein the cover member is movable to provide access to the base member upper opening, thereby allowing a user to insert the bottle into the dispensing unit.

14. A gravity fed fluid dispensing assembly, comprising:

(a) a dispensing unit;

(b) a bottle movably connected with the dispensing unit; and (c) an enclosure as defined in claim 1.

15. A dispensing station comprising a plurality of dispensing assemblies as defined in claim 14, wherein each dispensing assembly is in fluid communication with the next adjacent dispensing assembly.

* * * * *